US010718230B2

(12) United States Patent
Littler

(10) Patent No.: US 10,718,230 B2
(45) Date of Patent: Jul. 21, 2020

(54) UNISON RING ASSEMBLY

(71) Applicant: ROLLS-ROYCE plc, London (GB)

(72) Inventor: Graham Littler, Nottingham (GB)

(73) Assignee: ROLLS-ROYCE PLC, London (GB)

( * ) Notice: Subject to any disclaimer, the term of this patent is extended or adjusted under 35 U.S.C. 154(b) by 271 days.

(21) Appl. No.: 16/036,191

(22) Filed: Jul. 16, 2018

(65) Prior Publication Data

US 2019/0024531 A1 Jan. 24, 2019

(30) Foreign Application Priority Data

Jul. 19, 2017 (GB) ..... 1711582.5

(51) Int. Cl.

| | |
|---|---|
| ***F01D 17/16*** | (2006.01) |
| ***F04D 29/56*** | (2006.01) |
| ***F01D 9/04*** | (2006.01) |
| ***F01D 25/24*** | (2006.01) |

(52) U.S. Cl.

CPC ..... *F01D 17/162* (2013.01); *F01D 9/041* (2013.01); *F01D 25/243* (2013.01); *F01D 25/246* (2013.01); *F04D 29/563* (2013.01); *F05D 2230/64* (2013.01); *F05D 2250/51* (2013.01); *F05D 2260/50* (2013.01); *F05D 2260/74* (2013.01)

(58) Field of Classification Search

CPC .... F01D 17/162; F01D 25/243; F01D 25/246; F01D 9/041; F04D 29/563; F05D 2230/64; F05D 2250/50; F05D 2250/51; F05D 2260/50; F05D 2260/74

See application file for complete search history.

(56) References Cited

U.S. PATENT DOCUMENTS

| | | | | |
|---|---|---|---|---|
| 3,314,595 A * | 4/1967 | Burge | ..... | F01D 17/162 415/160 |
| 3,325,087 A * | 6/1967 | Davis | ..... | F01D 17/162 415/209.3 |
| 3,584,857 A * | 6/1971 | Hipsher | ..... | F16F 1/38 267/281 |

(Continued)

FOREIGN PATENT DOCUMENTS

| | | |
|---|---|---|
| EP | 2481891 | 8/2012 |

OTHER PUBLICATIONS

Great Britain Search Report dated Dec. 19, 2017, issued in GB Patent Application No. 1711582.5.

*Primary Examiner* — David E Sosnowski
*Assistant Examiner* — Wayne A Lambert
(74) *Attorney, Agent, or Firm* — Oliff PLC

(57) ABSTRACT

A unison ring assembly for a gas turbine engine has a unison ring and a plurality of levers extending from the unison ring. Each lever has a pin at one end that inserts through a bore of a respective bush mounted in the unison ring. Each bush is formed as separate first and second parts which are mounted to their through-hole by inserting the first part into the through-hole from one side of the unison ring and the second part into the through-hole from the opposing side of the unison ring. Each part has a respective stop which prevents that part from inserting into the through-hole by more than a predetermined amount. When both parts are inserted by their predetermined amounts, their ends join together to form the bush and prevent the parts being retracted from the through-hole.

20 Claims, 4 Drawing Sheets

(56) References Cited

U.S. PATENT DOCUMENTS

| | | | | |
|---|---|---|---|---|
| 3,685,920 | A * | 8/1972 | Burge | F01D 17/162 415/147 |
| 4,363,580 | A * | 12/1982 | Bell | F16B 19/10 411/15 |
| 4,756,640 | A * | 7/1988 | Gehrke | F16B 21/16 403/326 |
| 4,925,364 | A * | 5/1990 | Das | F01D 17/162 415/150 |
| 6,796,767 | B2 * | 9/2004 | Bouru | F01D 17/16 403/286 |
| 7,588,416 | B2 * | 9/2009 | Bouru | F01D 17/162 415/160 |
| 8,794,910 | B2 * | 8/2014 | Gasmen | F01D 17/162 415/160 |
| 2003/0014773 | A1 | 8/2003 | Chatel et al. | |
| 2003/0147743 | A1 * | 8/2003 | Chatel | F01D 17/162 415/160 |
| 2004/0146398 | A1 * | 7/2004 | Bromann | F01D 17/16 415/148 |
| 2004/0208742 | A1 * | 10/2004 | Raulin | F01D 17/162 415/160 |
| 2006/0062667 | A1 | 3/2006 | Bourgoin et al. | |
| 2017/0356305 | A1 * | 12/2017 | Mena-Dominguez | F01D 25/162 |
| 2018/0080338 | A1 * | 3/2018 | Kennedy | F04D 29/563 |

* cited by examiner

UNISON RING ASSEMBLY

CROSS-REFERENCE TO RELATED APPLICATIONS

This application is based upon and claims the benefit of priority from British Patent Application No. GB 17011582.5, filed on 19 Jul. 2017, the entire contents of which are incorporated by reference.

BACKGROUND

Technical Field

The present disclosure relates to a unison ring assembly.

Description of the Related Art

A gas turbine engine compressor typically has a row of inlet guide vanes and plural compressor stages, each stage comprising a set of stator vanes which receive and redirect the working fluid issuing from the rotating blades of the preceding stage. As aero engines have to operate at varying speeds and inlet conditions, it can be advantageous to be able to alter the aerodynamic flow angle of individual inlet guide vanes and stator vanes within the gas turbine annulus, depending upon the present engine operating speed and conditions. Vanes whose flow angles are alterable in this way are known as variable vanes.

A large variety of systems are used to actuate variable vanes. In particular, unison rings can be used to rotate variable vanes about their radial axes and thereby change the aerodynamic flow angle. Each unison ring encircles a casing of the engine and is rotated by one or more actuators to produce movement in the circumferential direction. This movement is then converted by an arrangement of levers and spindles into the rotation of the variable vanes.

SUMMARY

FIG. 1 shows an overhead view of several unison ring assemblies for actuating variable vanes. The unison rings 100 are manipulated by a linear actuator 101 via a crankshaft 102 and connecting rods 103. This manipulation produces rotation of the unison rings around a compressor case, which in turn causes the variable vanes to rotate to the desired angle via levers 104 that are connected to spindles projecting from the ends of the vanes and are rotatably connected to the unison rings by lever pins.

FIG. 2 then shows an engine longitudinal cross-section through the end of a variable vane 105 (specifically, a variable inlet guide vane), its spindle 106, lever 104 and unison ring 100. One end of the lever has an engagement formation 107 that engages the lever to the variable vane spindle. The lever pin 108 projects from the other end of the lever and inserts through a bore of a bush 109, which in turn is received in a through-hole formed in the (hollow) unison ring. The bush allows the lever pin to rotate smoothly in the unison ring.

Because the unison ring 100 is angled away from engine axis, as the lever 104 rotates away from alignment to the engine axis the lever and the unison ring move closer to each other, causing the pin 108 to further penetrate the unison ring by sliding along the bore of the bush 109. When the lever rotates back towards alignment with engine axis, the lever and the unison ring move apart, causing the pin to slide back out of the bush. The bush has a flange 110 at one end that locates against an outside surface of a wall of the unison ring when the bush is push-fitted into the respective unison ring through-hole on assembly and prevents the bush from sliding further into the unison ring as the pin slides along the bore of the bush. A lightly raised bump 111 on the outer surface of the bush locates against the inside surface of the wall of the unison ring. The bump is sized to permit the push-fitting insertion of the bush into the through-hole, and provides resistance to the bush sliding out the unison ring as the pin slides along the bore of the bush.

The lever's rotation away from engine axis alignment also causes the lever pin 108 and vane spindle 106 to move out of parallel. This causes the lever 104 to twist, with the result that the lever pin is forced into stronger contacts with the bush 109 at opposite end and sides, as indicated by the arrows in FIG. 3. This is can be referred to as cross-binding of the lever pin.

A combination of the cross-binding of the pin 108 and the action of the pin sliding out of the bush 109 as the lever 104 rotates back towards engine axis can cause the bush to migrate out of the unison ring 100, despite the resistance provided by the raised bump 111. This migration can make the bush less effective at correctly locating the lever pin for vane manipulation, and as a result can lead to inaccuracies in vane positioning.

It would be desirable to prevent bush migration.

Accordingly, in a first aspect, the present disclosure provides a unison ring assembly for rotating a circumferential row of variable vanes of a gas turbine engine, the assembly having:

a unison ring rotatable about a central axis;

a plurality of circumferentially spaced levers extending from the unison ring, each lever having a pin at one end thereof that inserts through a bore of a respective bush mounted in a respective through-hole of the unison ring, thereby rotatably connecting the lever to the unison ring at the pin, and each lever further having an engagement formation at the other end thereof that engages the lever to a spindle projecting from an end of a respective one of the variable vanes, whereby rotation of the unison ring about its central axis causes the levers to rotate the variable vanes about their spindles;

wherein each bush is formed as separate first and second parts which are mounted to their through-hole by inserting a leading end of the first part into the through-hole from one side of the unison ring and a leading end of the second part into the through-hole from the opposing side of the unison ring, each part having a respective stop which prevents that part from inserting into the through-hole by more than a predetermined amount, and the leading ends being configured such that, when both parts are inserted by their predetermined amounts, the leading ends join together to form the bush and prevent the parts being retracted from the through-hole.

By forming the bush as separate first and second parts, the bush can still be mounted to the unison by simple push-fit procedures. However, when the leading ends are joined, the stops at opposing sides of the unison ring can prevent bush migration.

In a second aspect, the present disclosure provides a gas turbine engine having one or more circumferential rows of variable vanes and one or more unison ring assemblies according to the first aspect for rotating the variable vanes.

In a third aspect, the present disclosure provides a kit of parts for forming the unison ring assembly of the first aspect, the kit including: the unison ring, the levers, and the first and second parts of the bushes.

Optional features of the present disclosure will now be set out. These are applicable singly or in any combination with any aspect of the present disclosure.

The leading ends may be configured such that one of the leading ends snap-fits to the other leading end when both parts are inserted by their predetermined amounts. This helps to simplify mounting of the first and second parts to their through-hole. For example, one of the leading ends may have a plurality of hooks which are elastically deformable to snap-fit to a retainer provided by the other leading end when both parts are inserted by their predetermined amounts. Such hooks may be circumferentially spaced around the axis of the bush and separated from each other by axially-extending slots.

Conveniently, each stop may be provided by a flange formed at the end of the respective part distal from its leading end.

DESCRIPTION OF THE DRAWINGS

Embodiments of the present disclosure will now be described by way of example with reference to the accompanying drawings in which.

DETAILED DESCRIPTION

Figure 4:
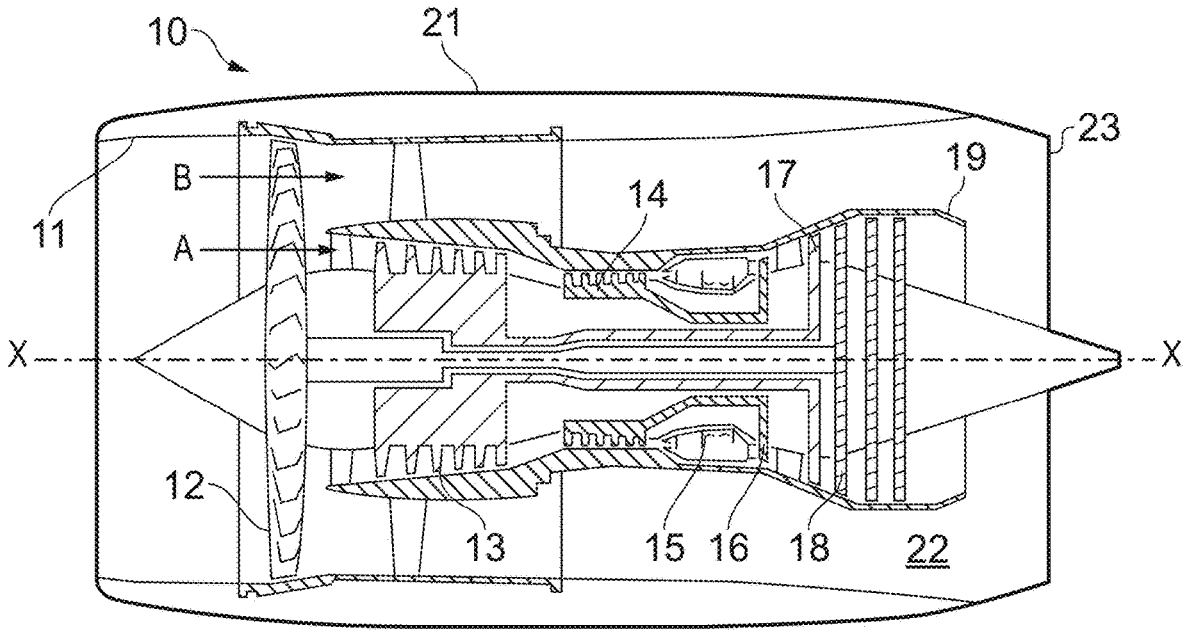
FIG. 4 shows a longitudinal cross-section through a ducted fan gas turbine engine.

With reference to FIG. 4, a ducted fan gas turbine engine is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate-pressure compressors 14, 13 and the fan 12 by suitable interconnecting shafts.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Figure 1:
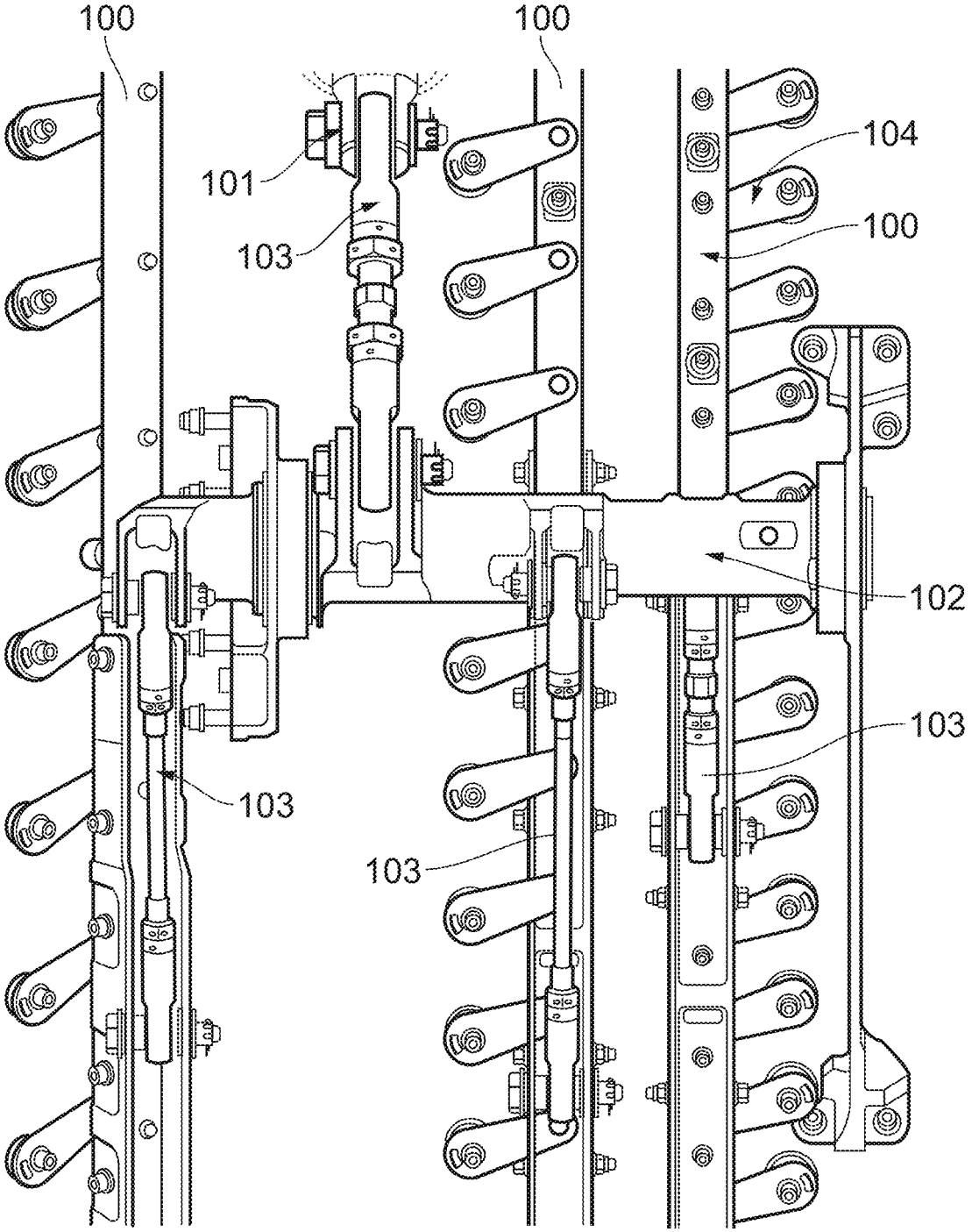
FIG. 1 shows an overhead view of several unison ring assemblies for actuating variable vanes.
Figure 2:
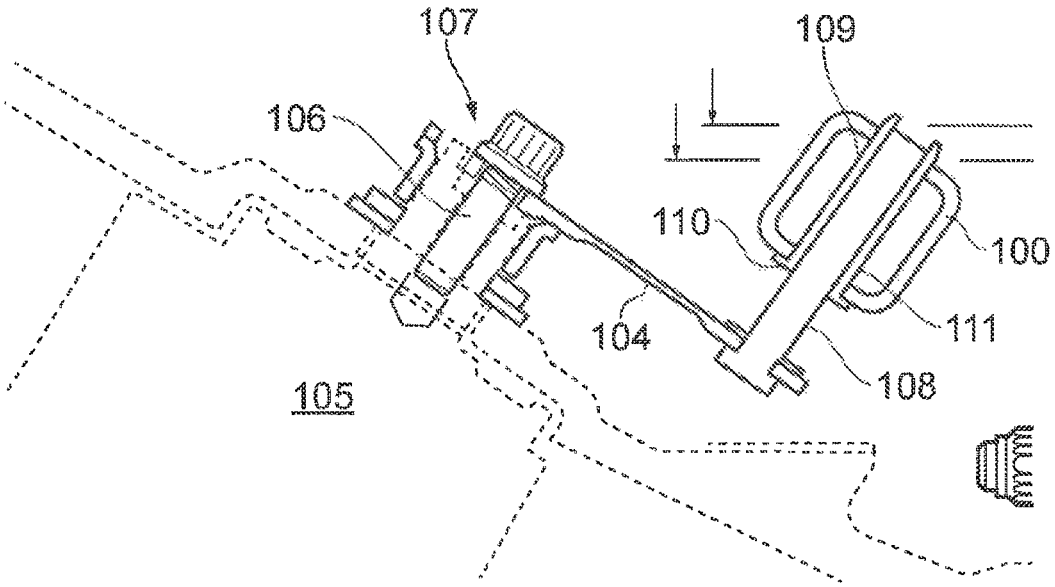
FIG. 2 (PRIOR ART)
FIG. 2 shows an engine longitudinal cross-section through the end of a variable vane, a vane spindle, lever and unison ring.
Figure 3:
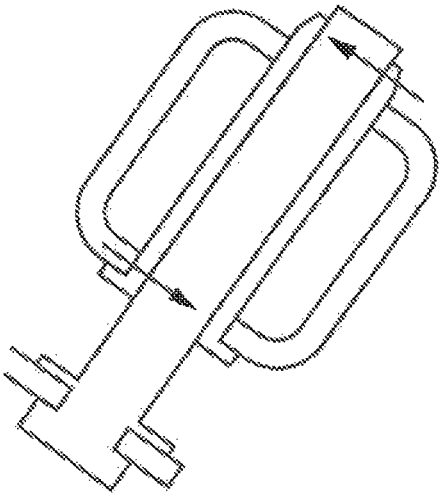
FIG. 3 (PRIOR ART)
FIG. 3 indicates cross-binding forces acting on a lever pin.
Figure 5:
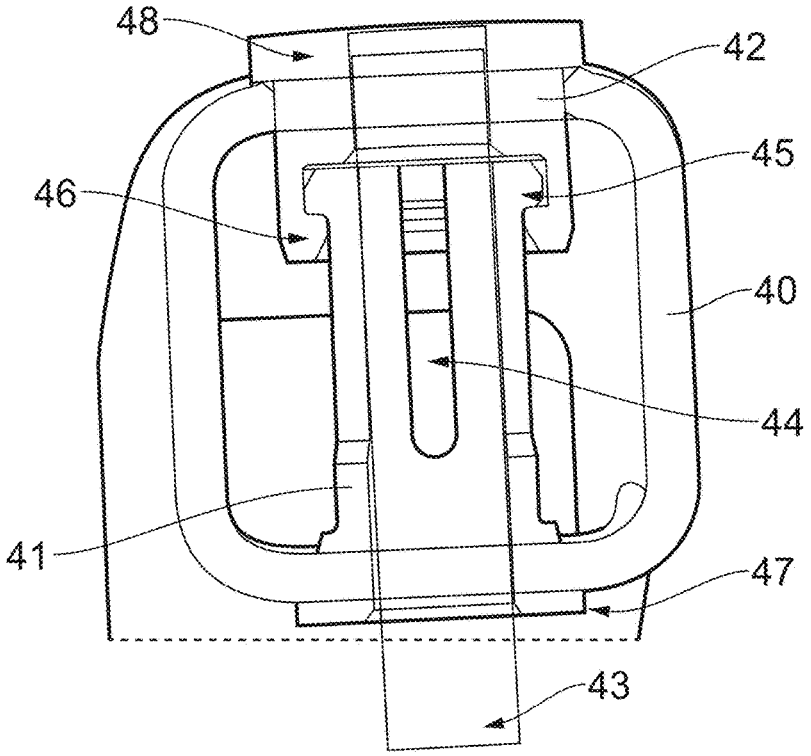
FIG. 5 shows an engine longitudinal cross-section through a bush and a unison ring of unison ring assembly.
Figure 6:
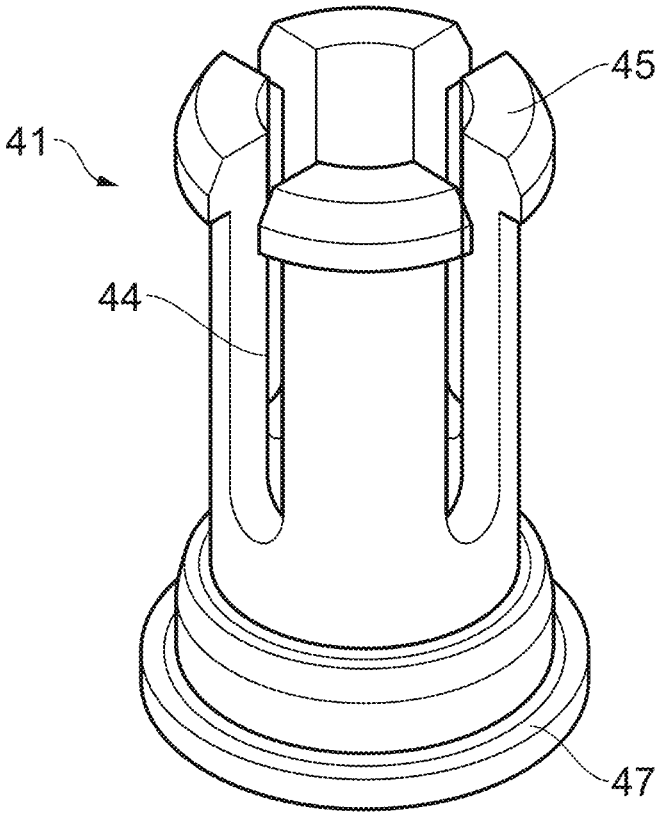
FIG. 6 shows a perspective view of an inner part of the bush of FIG. 5.
Figure 7:
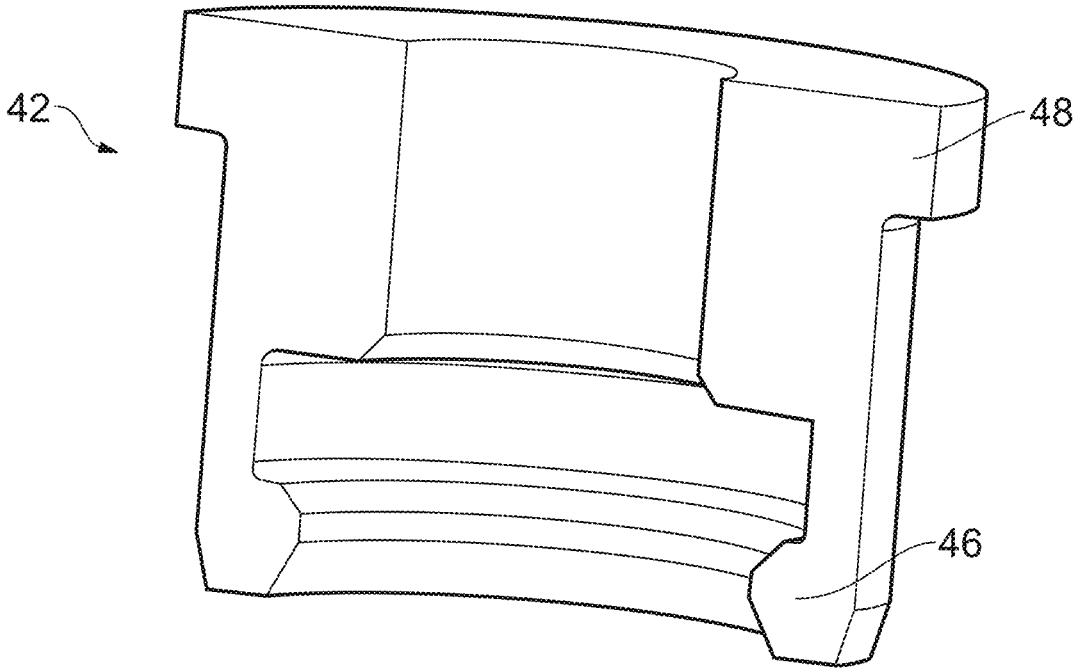
FIG. 7 shows a cross-section through an outer part of the bush of FIG. 5.

The intermediate-compressor 13 has variable inlet guide vanes and variable stator vanes controlled by respective unison ring assemblies. These assemblies can be similar to those discussed above and illustrated in respect or FIGS. 1 to 3, except that instead of the single piece bush 109, each lever has a bush formed from separate first (inner) and second (outer) parts. FIG. 5 shows an engine longitudinal cross-section through a two-part bush and a unison ring 40 of such an assembly. FIG. 6 shows a perspective view of the inner part 41 of the bush, and FIG. 7 shows a cross-section through the outer part 42. Also shown in transparent on FIG. 5 is the position of a lever pin 43 when located in the bore of the bush.

The two parts 41, 42 insert into the respective through-hole of the unison ring 40 from opposite sides. Each part has a retention feature at its leading end that locks to the corresponding retention feature of the other. For example, one of the parts (the inner part in FIGS. 5 to 7) can have axially-extending slots 44 which space and define plural (four as drawn in FIGS. 5 and 6) elastically deformable hooks 45, while the other part (the outer part in FIGS. 5 to 7) can have a circular retaining lip 46. When the leading ends of the inner and outer parts meet in the middle of the unison ring, the hooks flex inwards and spring back to locate over the lip, joining the two parts with a snap-fit action.

At the distal ends of the parts 41, 42 respective "top hat" flanges 47, 48 locate against the outer surface of the unison ring 40 to define a predetermined insertion distance for each part. The two parts are configured so that the snap-fit joining of the parts occurs when both parts are fully inserted, i.e. so that the flanges allow little or no play of the bush in its axial directions in the through-hole of the unison ring 40.

The two-part form of the bush with its snap-fit retention features provide several advantages. In particular:

- The retention feature 45, 46*s* remain joined after snap-fitting, and help to prevent accidental removal of the bush during the process of completing the unison ring assembly.
- The retention features are locked in place by the insertion of the lever pin 43. That is, when the lever pin 43 is inserted into the bush, the hooks 45 are prevented from flexing inwardly enough to unhook themselves from the retaining lip 46.
- When the two parts 41, 42 are joined together, the "top hat" flanges 47, 48 prevent the bush from moving in both axial directions. Therefore even under the combined effects of sliding and cross-binding of the pin 43, the bush remains correctly located in its through-hole, helping to maintain accurate vane positioning. In addition, the prevention of this movement helps to stop fretting at the cusps of the flanges.
- The two-part bush is easy to assemble to the unison ring 40.
- The slots 44 are positioned away from where the bush makes contact with the unison ring 40 and hence are spaced from locations of high stress, thereby maintaining good bush hoop strength where it is required.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting.

Various changes to the described embodiments may be made without departing from the spirit and scope of the disclosure.

The invention claimed is:

1. A unison ring assembly for rotating a circumferential row of variable vanes of a gas turbine engine, the assembly having:

a unison ring rotatable about a central axis;

a plurality of circumferentially spaced levers extending from the unison ring, each lever having a pin at a first end thereof that inserts through a bore of a respective bush mounted in a respective through-hole of the unison ring, thereby rotatably connecting each respective lever to the unison ring at the respective pin, and each lever further having an engagement formation at a second end thereof that engages each respective lever to a spindle projecting from an end of a respective one of the variable vanes, whereby rotation of the unison ring about its central axis causes the levers to rotate the variable vanes about their spindles;

wherein each bush is formed as a first and a second part separate from one another, the first part and the second part being mounted to the respective through-hole by inserting a leading end of the first part into the through-hole from one side of the unison ring and a leading end of the second part into the through-hole from an opposing side of the unison ring, each of the first part and the second part having a respective stop which prevents the first part and the second part from inserting into the through-hole by more than a predetermined amount, and wherein the leading end of the first part and the leading end of the second part are configured such that, when the first part and the second part are inserted by the predetermined amounts, the leading end of the first part and the leading end of the second part join together in the middle of the unison ring to form the bush and prevent the first part and the second part from being retracted from the through-hole.

2. The unison ring assembly according to claim 1, wherein the leading end of the first part and the leading end of the second part are configured such that the leading end of the first part snap-fits to the leading end of the second part when both the first part and the second part are inserted by the predetermined amounts.

3. The unison ring assembly according to claim 2, where each of the respective stops is provided by a flange formed at an end of a respective one of the first part and the second part distal from a leading end of the respective one of the first part and the second part.

4. A gas turbine engine having one or more circumferential rows of variable vanes and at least one unison ring assembly according to claim 2 for rotating the variable vanes.

5. A kit of parts for forming the unison ring assembly of claim 2, the kit including:

the unison ring, the plurality of levers, and the first part and the second part of each of the bushes.

6. The unison ring assembly according to claim 2, wherein a first one of the leading end of the first part and the leading end of the second part has a plurality of hooks which are elastically deformable to snap-fit to a retainer provided by a second one of the leading end of the first part and the leading end of the second part when the first part and the second part are inserted by the predetermined amounts.

7. The unison ring assembly according to claim 6, where each of the respective stops is provided by a flange formed at an end of a respective one of the first part and the second part distal from a leading end of the respective one of the first part and the second part.

8. A gas turbine engine having one or more circumferential rows of variable vanes and at least one unison ring assembly according to claim 6 for rotating the variable vanes.

9. A kit of parts for forming the unison ring assembly of claim 6, the kit including:

the unison ring, the plurality of levers, and the first part and the second part of each of the bushes.

10. The unison ring assembly according to claim 6, wherein the plurality of hooks are circumferentially spaced around an axis of the bush and are separated from each other by axially-extending slots.

11. The unison ring assembly according to claim 10, where each of the respective stops is provided by a flange formed at an end of a respective one of the first part and the second part distal from a leading end of the respective one of the first part and the second part.

12. A gas turbine engine having one or more circumferential rows of variable vanes and at least one unison ring assembly according to claim 10 for rotating the variable vanes.

13. A kit of parts for forming the unison ring assembly of claim 10, the kit including:

the unison ring, the plurality of levers, and the first part and the second part of each of the bushes.

14. The unison ring assembly according to claim 10, wherein, in use, the slots are positioned away from a location where the respective bush makes contact with the unison ring.

15. The unison ring assembly according to claim 14, where each of the respective stops is provided by a flange formed at an end of a respective one of the first part and the second part distal from a leading end of the respective one of the first part and the second part.

16. A gas turbine engine having one or more circumferential rows of variable vanes and at least one unison ring assembly according to claim 14 for rotating the variable vanes.

17. A kit of parts for forming the unison ring assembly of claim 14, the kit including:

the unison ring, the plurality of levers, and the first part and the second part of each of the bushes.

18. The unison ring assembly according to claim 1, where each of the respective stops is provided by a flange formed at an end of a respective one of the first part and the second part distal from a leading end of the respective one of the first part and the second part.

19. A gas turbine engine having one or more circumferential rows of variable vanes and at least one unison ring assembly according to claim 1 for rotating the variable vanes.

20. A kit of parts for forming the unison ring assembly of claim 1, the kit including:

the unison ring, the plurality of levers, and the first part and the second part of each of the bushes.

* * * * *